US010707618B2

(12) United States Patent
Leigh et al.

(10) Patent No.: US 10,707,618 B2
(45) Date of Patent: Jul. 7, 2020

(54) CONNECTOR MOUNTS

(71) Applicant: Hewlett Packard Enterprise Development LP, Houston, TX (US)

(72) Inventors: Kevin B. Leigh, Ouston, TX (US); George D. Megason, Spring, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/560,216

(22) PCT Filed: Apr. 3, 2015

(86) PCT No.: PCT/US2015/024329
§ 371 (c)(1),
(2) Date: Sep. 21, 2017

(87) PCT Pub. No.: WO2016/160034
PCT Pub. Date: Oct. 6, 2016

(65) Prior Publication Data
US 2018/0054024 A1 Feb. 22, 2018

(51) Int. Cl.
*H01R 13/631* (2006.01)
*H01R 13/516* (2006.01)

(52) U.S. Cl.
CPC ..... *H01R 13/6315* (2013.01); *H01R 13/516* (2013.01); *H01R 2201/06* (2013.01)

(58) Field of Classification Search
CPC ..... H01R 13/6315; H01R 13/631; H01R 13/516; H01R 2201/06
USPC ..... 439/247, 248
See application file for complete search history.

(56) References Cited

U.S. PATENT DOCUMENTS 4,647,129 A * 3/1987 Kandybowski ..... H01R 13/629 439/246
4,812,133 A 3/1989 Fleak et al.
4,815,986 A 3/1989 Dholoo
5,647,764 A 7/1997 Kimura
5,755,584 A * 5/1998 Kodama ..... H01R 13/6315 439/248
5,803,758 A * 9/1998 Kameyama ..... H01R 13/6315 439/248

(Continued)

FOREIGN PATENT DOCUMENTS

CN 101859957 A 10/2010
CN 102116911 A 7/2011

(Continued)

OTHER PUBLICATIONS

International Search Report and Written Opinion received for PCT Patent Application No. PCT/US2015/024329, dated Dec. 30, 2015, 9 pages.

(Continued)

*Primary Examiner* — Gary F Paumen
(74) *Attorney, Agent, or Firm* — Hewlett Packard Enterprise Patent Department

(57) ABSTRACT

An example connector mount may comprise a bracket to receive a connector. The example connector mount may further comprise a first and second guide spring disposed on the bracket. Each of the first and second guide springs may be to engage with the connector and each provide resistance to movement of the connector in a horizontal, and a vertical direction.

8 Claims, 9 Drawing Sheets

(56) References Cited

U.S. PATENT DOCUMENTS 6,159,030 A * 12/2000 Gawron ..... H01R 13/6315 439/247
6,196,856 B1 3/2001 De Villeroche
6,325,652 B1 * 12/2001 Grant ..... H01R 13/6315 439/248
6,343,939 B1 * 2/2002 Inoue ..... B60N 2/015 439/248
6,579,111 B2 * 6/2003 Fukamachi ..... H01R 13/62933 439/247
7,361,041 B2 * 4/2008 Hashiguchi ..... H01R 13/6315 439/247
7,507,099 B2 3/2009 Cowgill et al.
7,661,970 B2 * 2/2010 Fukamachi ..... H01R 13/62933 439/157
7,695,325 B2 * 4/2010 Asari ..... H01R 13/4362 439/752
7,991,252 B2 8/2011 Cheng et al.
8,465,312 B2 * 6/2013 Di Stefano ..... H01R 13/24 439/248
8,545,247 B2 * 10/2013 Aldana ..... H01R 13/6315 439/248
9,057,849 B2 * 6/2015 Park ..... G02B 6/3823
2003/0162429 A1 * 8/2003 Sato ..... B41J 29/02 439/246
2006/0148293 A1 * 7/2006 Herring ..... H01R 13/6315 439/247
2006/0240696 A1 * 10/2006 Ide ..... H01R 13/506 439/248
2007/0178740 A1 8/2007 Hashiguchi et al.
2007/0218736 A1 * 9/2007 Takizawa ..... H01R 11/01 439/247
2009/0130877 A1 5/2009 Fukamachi
2011/0053399 A1 * 3/2011 Fahllund ..... H01R 13/6315 439/325
2012/0288238 A1 11/2012 Park et al.
2014/0199868 A1 * 7/2014 Okamoto ..... H01R 13/14 439/247

FOREIGN PATENT DOCUMENTS

CN 102280765 A 12/2011
JP 02273708 11/1990
JP 2006294513 10/2006
KR 10-2009-0040235 4/2009

OTHER PUBLICATIONS

International Preliminary Report on Patentability received for PCT Patent Application No. PCT/US2015/024329, dated Oct. 12, 2017, 8 pages.

* cited by examiner

CONNECTOR MOUNTS

BACKGROUND

Computer systems may have components that engage with one another through mechanical connectors. The mechanical connectors may be conduits for, or enable the transmission of, signals from one computer component to another. Mechanical connectors may need to be properly aligned with each other in order to correctly mechanically engage such that the transmission of signals can occur.

DETAILED DESCRIPTION

Figure 1A:
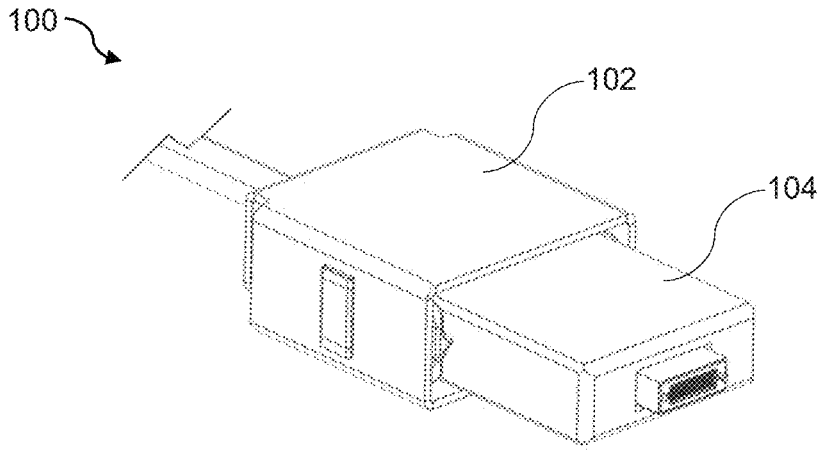
FIG. 1A is a perspective view of an example connector mount.

Components of computer systems, including server systems, may engage with one another through the use of mechanical connectors. In some situations, a rack-mount server or blade server may employ mechanical connectors in order to engage the server with the other components of the system, or server enclosure. The mechanical connectors may be conduits for data or signals to be transmitted from one computer component to another. The signals may include electrical signals, optical signals, or other signals.

In some situations, the mechanical connectors may be engaged through a blind-mate connection. Blind-mate connections may refer to the engagement or mating of mechanical connectors without any visual or tactile indications of the proper alignment of the connectors. In some computer systems, components may be inserted into receiving systems, bays, cavities, racks, or trays at an improper angle for alignment of the component's connector with the intended mating connector, because of the blind-mate nature of the connection. Therefore, in such a situation, the mechanical connector of the inserted component may be slightly or very misaligned with the intended mating connector of the receiving component or system, thereby causing an interference between the connectors, or preventing the proper mating of the connectors. In some situations, however, such an interference due to the misalignment may result in the mating force, or the force causing the attempted mating of the connectors, to shift the position of the inserted computer component until the misalignment is eliminated and the connectors can properly mate. This may occur when the inserted component is a relatively small component, such as network line card, or other lightweight computer card or component.

In some situations, the inserted computer component may be a larger component, such as a server being inserted into a server enclosure, or rack, and the component may include one or more blind-mate connections. The inserted component may still be inserted such that the component's blind-mate connector is misaligned with the intended mating connector in the receiving system or enclosure. Such a misalignment may prevent the connectors from properly mating with one another, and, therefore, may prevent the transmission of data or signals through the connectors from one computer component to another. Moreover, such a misalignment may not correct itself by the shifting of the inserted component, as described above, due to the larger size and/or weight of the inserted component. Such a misalignment may, therefore, result in a failed blind-mating attempt.

Implementations of the present disclosure provide a connector mount that can mount a connector to a computer component and allow the connector to linearly and rotationally float within the mount in three dimensions and to self-center within the mount. The ability to float in three dimensions allows the connector to compensate for a misalignment of the inserted component in a blind-mate situation, and, thus, a misalignment of the connector itself with the intended mating connector within the receiving system. Once the component is inserted into the receiving system in a misaligned manner, the inserted component's connector may interfere with the mating connector. This interference may cause the misaligned connector to move in any of the connector's three dimensions of float within the mount until the floated connector is sufficiently aligned for engagement with the mating connector such that the mated connectors may exchange data or signals.

Figure 1B:
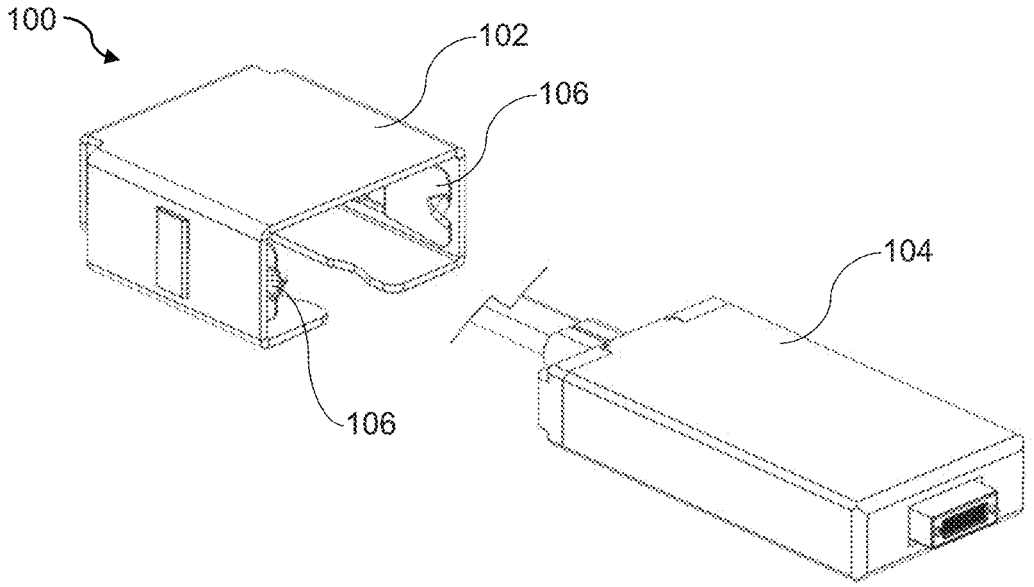
FIG. 1B is a perspective exploded view of an example connector mount.

Referring now to FIG. 1A, a perspective view of an example connector mount 100 is illustrated. Referring also to FIG. 1B, the example connector mount 100 is further illustrated in an exploded view. The example connector mount 100 may comprise a bracket 102 to receive a connector 104. The example connector mount 100 may further include a first guide spring 106 and a second guide spring 106.

The bracket 102 may be rigid or semi rigid support or housing that is capable of holding at least one guide spring 106. In some implementations, the bracket 102 may comprise separate or multiple portions, and, in further implementations, the bracket 102 may comprise a unitary portion. In some implementations, the bracket 102 may comprise a separate portion for each guide spring 106 disposed thereon. The bracket 102 may be constructed such that it can hold the guide springs 106 in a fixed or removably fixed position, relative to the component that the bracket 102 is disposed on. In some implementations, the bracket 102 may include rivets, screws, or other fasteners to retain the guide springs 106. In further implementations, the bracket 102 may include geometry or features such that the guide springs 106 can be pressed or slid onto the bracket 102. The bracket 102 may further be constructed such that it can hold the guide springs in opposing directions, or, in other words, facing each other. The bracket 102 may, further, hold the guide springs substantially opposite to each other, or, in some implementations, on opposite sides of the connector 104. In some implementations, the bracket 102 may comprise a metallic material, such as formed, bent, or machined metal. In further implementations, the bracket 102 may comprise sheet steel or sheet aluminum. In yet further implementations, the bracket 102 may comprise a polymer material, such as molded or machined plastic.

The bracket 102 may be a support or housing that is further capable of receiving a connector 104. In some implementations, the bracket 102 may receive the connector within it, such that the connector 104 is disposed fully or partially inside the bracket 102. In some implementations, the bracket 102 may receive the connector 104 within it with enough room between the connector 104 and the bracket 102 for the connector 104 to move up and down and side to side. In further implementations, the bracket 102 may receive the connector 104 such that the guide springs 106 are disposed on opposing sides of the connector 104. The bracket 102 may be constructed to allow the connector 104 to be slid into the bracket 102, between the guide springs 106. In some implementations, the bracket 102 may be constructed such that a cable, wire, or cord that may be attached to the connector 104 can be accommodated within or through the bracket 102. In further implementations, the bracket 102 may accommodate the cable attached to the connector 104 by including an aperture for the cable to pass through.

Referring still to FIGS. 1A-B, the connector mount 100 may receive a connector 104. The connector 104 may be a conduit for data or signals to be transmitted from one computer component to another. The connector 104 may be an electrical or optical connector to enable the transmission of electrical, optical, or other data signals. The connector 104 may comprise mechanical components to transmit signals, such as metal wire. In further implementations, the connector 104 may include optical fibers or be constructed such that the connector 104 can engage with or receive optical fibers. The optical fibers may comprise extruded glass or plastic, which may transfer light from one end of each fiber, to the other. The transferred light may comprise optical pulses or signals. In some implementations, the connector 104 may be to engage with a complementary, mating connector. The mating connector may comprise the same mechanical components to transmit signals as the connector 104, such that the connector 104, when engaged with the mating connector, can communicate the electrical, optical, or other signals to the mating connector.

Figure 1C:
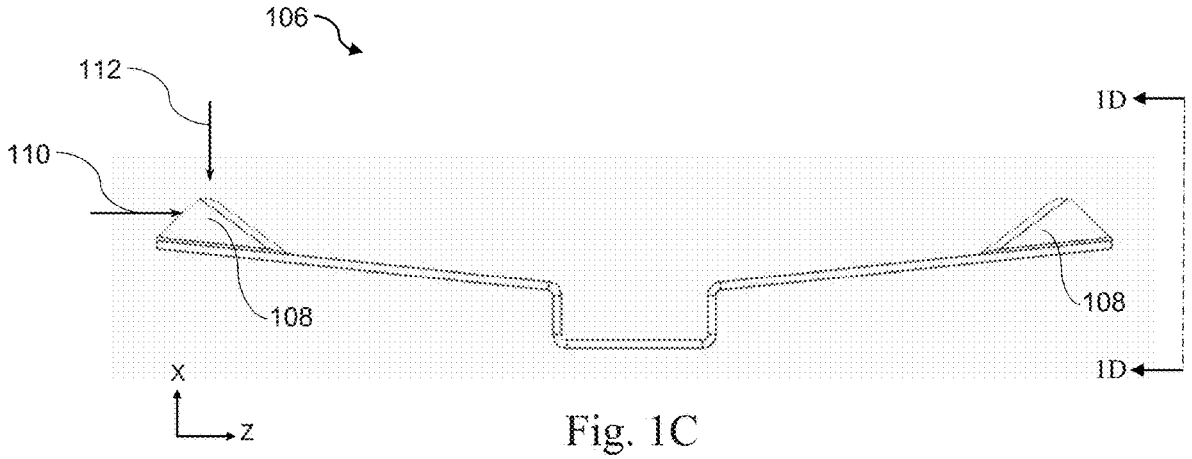
FIG. 1C is a top view of an example guide spring of an example connector mount.

The connector mount 100 may further include a first and second guide spring 106 to engage with the connector 104. Referring now to FIG. 1C, a top view of an example guide spring 106 is illustrated. Each guide spring 106 may be a resilient component that can return to its original shape after being deformed. Such an elastic deformation may occur in one or more of three dimensions. In some implementations, each guide spring 106 may provide a reactive force proportional to the degree of deformation of the guide spring 106. The reactive force may be proportionate to the deformation of the guide spring 106 in a linear, a progressive, or a degressive manner. In some implementations, the reactive force may be a constant reaction to the deformation of the guide spring 106. The guide spring 106 may comprise a coil or coils to achieve its elastic properties. In some implementations, the guide spring 106 may comprise a metallic material, such as spring steel. In further implementations, the guide spring 106 may comprise a polymer material, such as a plastic.

The guide spring 106 may comprise one or more compression springs that each react to a linear compressive deformation with a linear reactive force. In some implementations, the guide spring 106 may comprise one or more torsion springs that each react to an angular deformation with an angular reactive force. In further implementations, each guide spring 106 may comprise one or more tension or extension springs that each react to a stretching, or tensile, deformation with a linear reactive force in the opposite direction of the deformation. The guide spring 106 may further comprise one or more leaf springs. The leaf spring may have a rectangular cross-section and be constructed of a spring steel material, in some implementations. In yet further implementations, each guide spring 106 may comprise any combination of one or more of the above types of springs. Further, each guide spring 106 may be formed from a unitary piece of material, or from separate pieces of material. In some implementations, each guide spring 106 may comprise a separate piece of material for each direction of deformation.

Figure 1D:
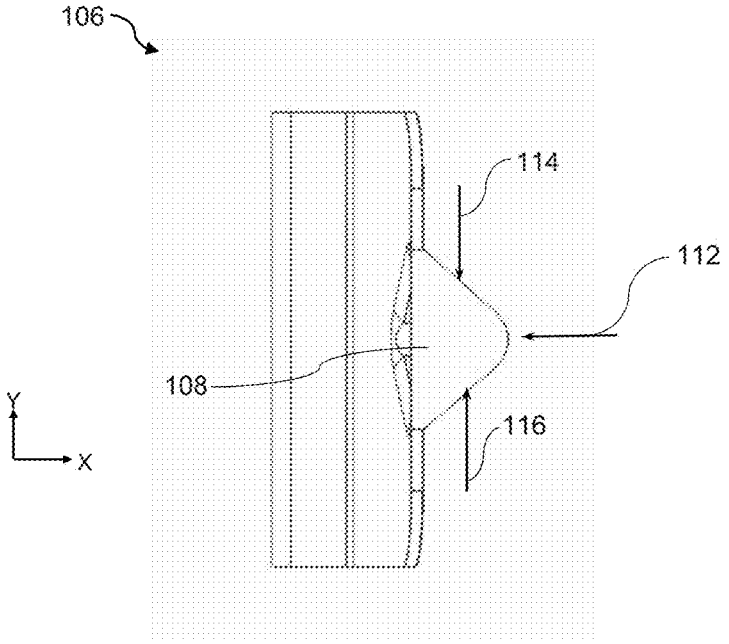
FIG. 1D is a side view of an example guide spring of an example connector mount.

Referring still to FIG. 1C, the example guide spring 106 may include one or more engagement portions 108. The engagement portions 108 may, alone or collectively, include geometry such that the guide spring 106 may provide a reactive force in response to deformation from a force applied in any of the three dimensions. In the present context, reference to one or more of the three dimensions refers to the X, Y, and Z dimensions in traditional Cartesian Coordinates. The X dimension and the Z dimension are illustrated in FIG. 1C, relative to the example guide spring 106. Further, referring additionally to FIG. 1D, the X dimension and the Y dimension are illustrated, relative to the example guide spring 106.

Referring again to FIG. 1C, the X dimension may be the bias direction of the guide spring 106 such that any deformation in the X dimension will cause the guide spring to provide a reactive force in the opposite direction of the X dimension, proportional to the deformation. As mentioned above, the guide spring 106 may include engagement portions 108. Each engagement portion 108 may transfer force in the Z dimension, for example, longitudinal direction 110, into deformation in the X dimension, against the reactive force of the guide spring 106. In other words, a force applied along direction 110 may be converted by the geometry of the engagement portion 108 into a deformation along direction 112. Direction 112 may be against the bias direction of the guide spring 106. Therefore, the guide spring 106 may provide a reactive force along the X dimension in response to a force applied in the Z dimension.

Referring again to FIG. 1D, a front view of the example guide spring 106, taken along view line 1D in FIG. 1C, is illustrated. As mentioned above regarding FIG. 1C, deformation in the X dimension (such as along horizontal direction 112) may be against the bias direction of the guide spring 106, and, thus, against the reactive force of the guide spring 106. Further, the engagement portion 108 may further include geometry to transfer force in the Y dimension, for example, vertical directions 114 or 116, into deformation in the X dimension, against the reactive force of the guide spring 106. In other words, a force applied along either vertical directions 114 or 116 may be converted by the geometry of the engagement portion 108 into a deformation along horizontal direction 112. Therefore, the guide spring 106 may provide a reactive force along the X dimension in response to a force applied in the Y dimension. Note, as used herein, "horizontal" direction may refer to a direction in the X dimension, "vertical" direction may refer to a direction in the Y dimension, and "longitudinal" direction may refer to a direction in the Z dimension, regardless of the visual orientation of each particular figure.

Figure 2A:
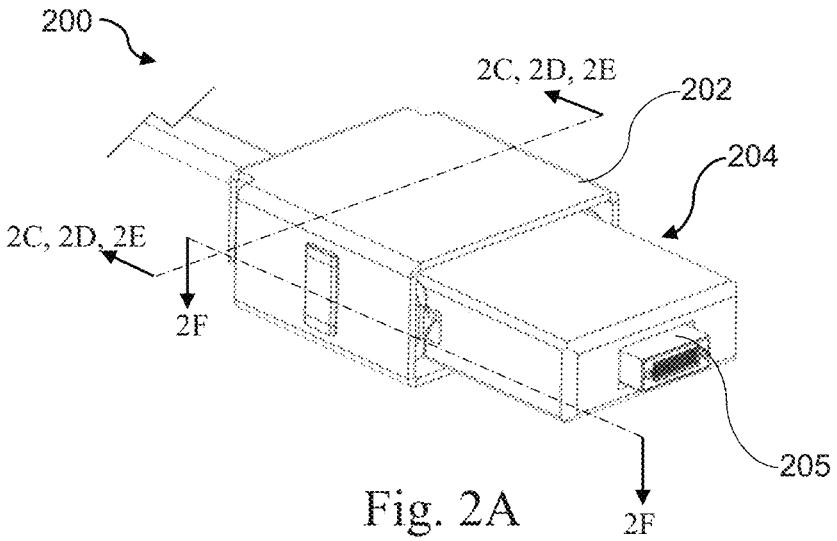
FIG. 2A is a perspective view of an example connector mount.
Figure 2B:
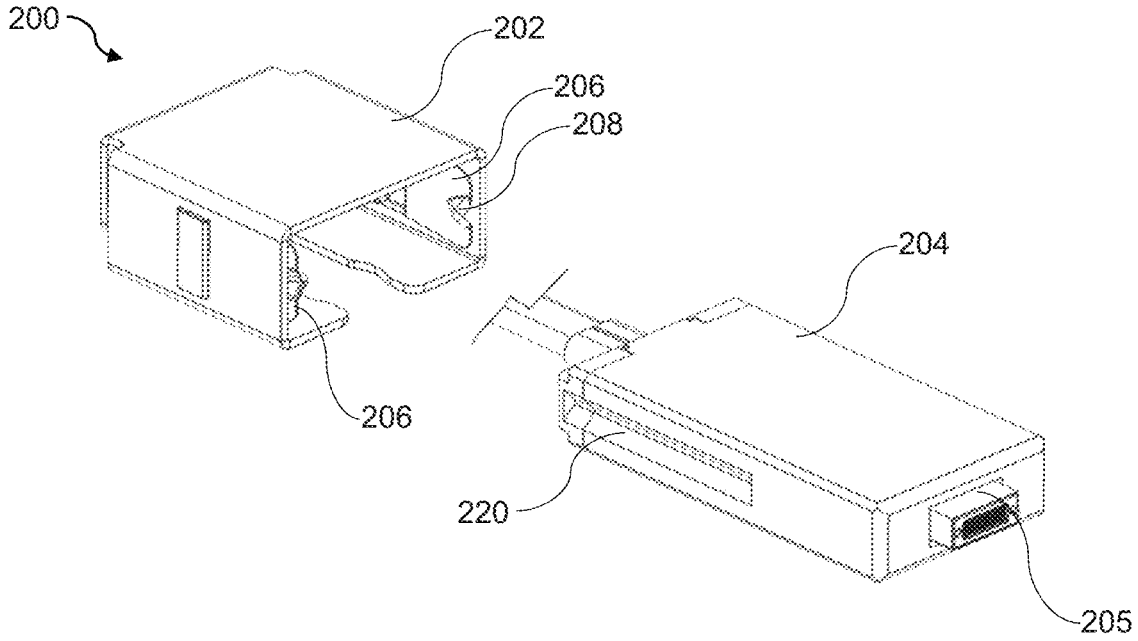
FIG. 2B is a perspective exploded view of an example connector mount.

Referring now to FIG. 2A, a perspective view of an example connector mount 200 is illustrated. Connector mount 200 may be similar to connector mount 100. Further, the similarly named elements of connector mount 200 may be similar in function to the elements of connector mount 100, as they are described above. The example connector mount 200 may comprise a connector 204, in order to form a connector mounting system. The connector 204 may be to engage with a first and second guide spring 206. In some implementations, the connector 204 may be to engage with the guide springs 206 within a bracket 202. The connector 204 may comprise a connection ferrule 205. The connection ferrule 205 may comprise mechanical components to transmit signals, such as metal wire to transmit electric signals, or optical fibers to transmit optical signals, or other components to transmit other data signals. The connection ferrule 205 may be constructed such that it can engage with a mating ferrule on a mating connector. The connection ferrule 205 may engage with a mating ferrule on a mating connector such that the connector 204 can transmit data signals to the mating connector through the connection ferrule 205 and the mating ferrule on the mating connector.

The connector 204 may further comprise a first and second engagement channel 220 to engage with the first and second guide springs 206, respectively. Each engagement channel 220 may comprise cutouts into and/or protrusions from the connector 204. The engagement channels 220 may, further, engage with engagement portions 208 of the guide springs 206. In some implementations, the engagement channels 220 may comprise complementary geometry to that of the engagement portions 208 of the guide springs 206. In some implementations, the engagement channels 220 may be disposed on opposite sides of the connector 204, and comprise oppositely-oriented geometry. In further implementations, the guide springs 206 may engage with the channels 220 such that, when engaged, the guide springs 206 are elastically deformed to a degree where the reactive force of each spring 206 urges the spring to maintain engagement with the respective engagement channel 220. Further, the guide springs 206 may maintain engagement with the channels 220 such that the connector is held in the bracket 202 by the reactive forces of the guide springs 206. In yet further implementations, the guide springs 206 may elastically hold the connector in a centered position within the bracket 202.

Figure 2C:
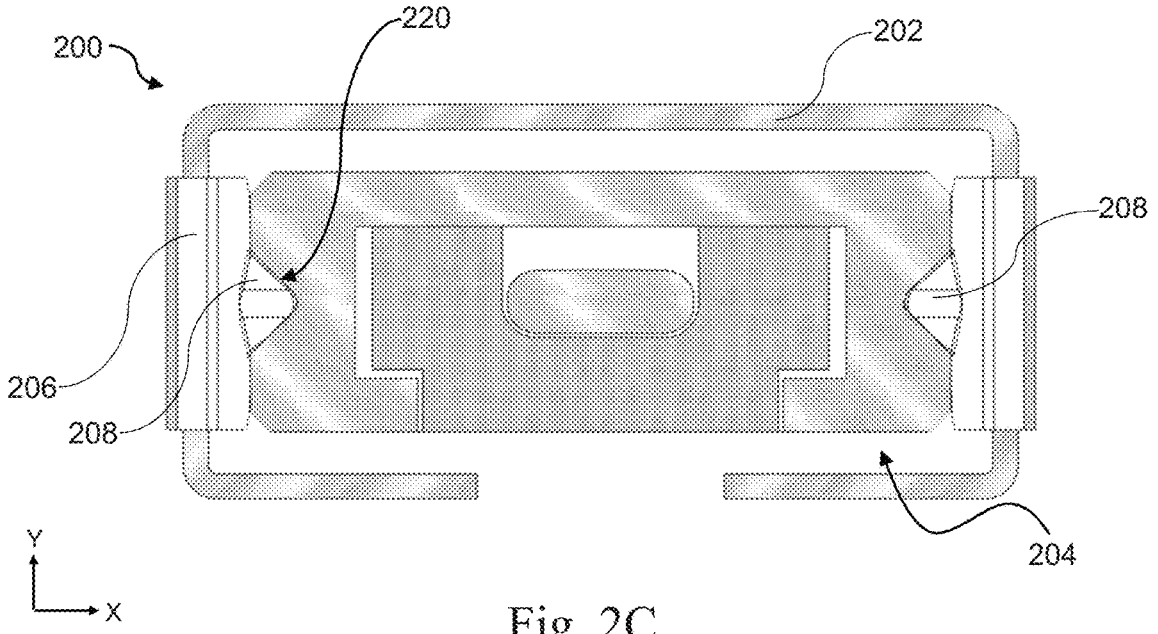
FIG. 2C is a front cross-sectional view of an example connector mount.

Referring now to FIG. 2C, a front cross-sectional view of the example connector mount 200 is illustrated. In some implementations, the engagement portions 208 of the guide springs 206 may insert into and engage with the engagement channels 220 of the connector 204. In further implementations, the guide springs 206 may be disposed on opposite sides of the bracket 202 and each engage with a separate engagement channel 220 disposed on the connector such that the channel 220 faces the respective guide spring 206. In some implementations, the engagement channels 220 may comprise angled surfaces such as a V-shaped cross-section, as illustrated in FIG. 2C. In further implementations, the engagement channels 220 may comprise a cross-section that is rounded, or ball-shaped. In yet further implementations, the engagement channels 220 may comprise a cross-section of a different shape. The engagement channels 220 may include geometry that is substantially complementary to the engagement portions 208. In this context, substantially complementary means that the complementary surfaces have matching geometry to such a degree that when the channels 220 move relative to the engagement portions 208, the engagement of the channels 220 with the portions 208 cause the elastic deformation of the guide springs 206, as illustrated in FIG. 2D, and described in further detail below.

Figure 2D:
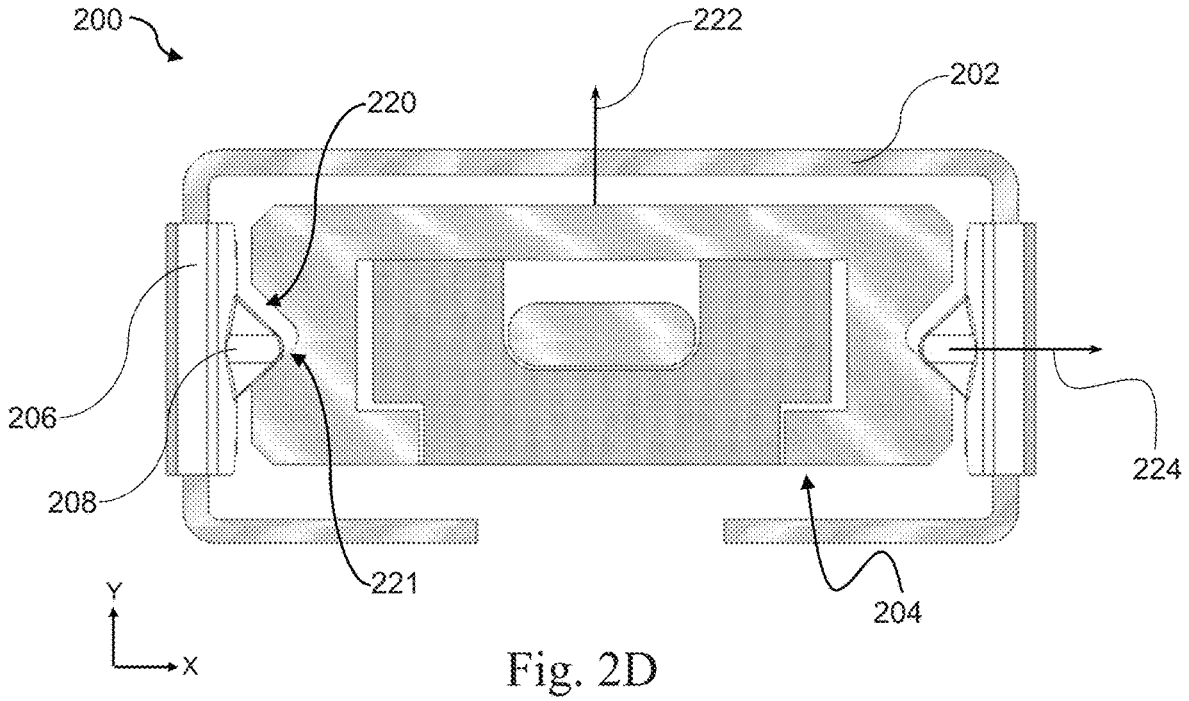
FIG. 2D is a front cross-sectional view of an example connector mount.

Referring now to FIG. 2D, a cross-sectional view of the example connector mount 200 is illustrated, in which the connector 204 has translated in a direction parallel to the view. The connector 204 may move against the reactive forces of the guide springs 206. In other words, the guide springs 206 may each provide resistance to movement of the connector 204. The internal surfaces of the engagement channels 220 may transfer such movement of the connector 204 into movement of the guide springs 206 by interacting with the geometry of the engagement portions 208 of the guide springs 206. For example, if the connector were to be moved in the Y dimension, such as in vertical direction 222, the lower angled surfaces 221 of the engagement channels 220 would contact the geometry of the engagement portions 208 of the springs 206 and cause the guide springs 206 to move in a horizontal, outwards direction (such as horizontal direction 224) along the X dimension. Additionally, the connector 204 may move directly horizontally, along the X dimension, in either direction. Such a movement would cause the internal surfaces of the engagement channel 220 that is disposed in that direction to move the respective guide spring 206 along the X dimension, directly against the reactive force of that guide spring 206. Thus, movement of the connector 204 in either of the X or Y dimensions may translate into movement of one or both of the guide springs 206 against their reactive force, the guide springs 206, thereby, resisting such a movement. Additionally, when the force causing the movement of the connector 204 ceases, the reactive forces of the elastically deformed guide springs 206 may cause the connector 204 to return to its resting position by way of the engagement portions 208 interacting with the interior surfaces of the engagement channels 220. In other words, the guide springs 206 may provide resistance to movement of the connector 204 (such that connector 204 is capable of resistably moving) in a horizontal X direction, or a vertical Y direction, and such resistance may urge the connector back into a centered position within the bracket 202.

Figure 2E:
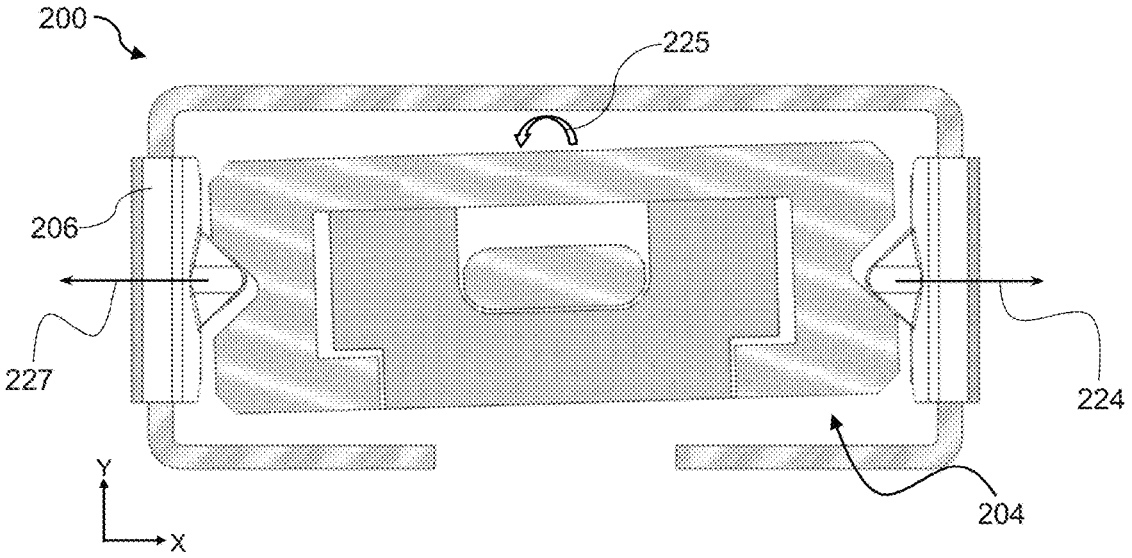
FIG. 2E is a front cross-sectional view of an example connector mount.

Referring now to FIG. 2E, a front cross-sectional view of the example connector mount 200 is illustrated, in which the connector 204 has rotated in a direction parallel to the view. The connector 204 may, in some situations, undergo a rotational movement or have a torque applied in the X-Y plane, or, the plane parallel to the view. Such a rotational movement, such as rotation 225, may act as a series or combination of linear movements in each or both of the X dimension and the Y dimension. As described above regarding translations of the connector 204 in the X and Y dimension, such linear movements may result in the elastic deformation of one or both of the guide springs 206, against their reactive forces. For example, connector 204 may undergo a rotational movement 225 in the X-Y plane. Such a rotation may cause the upper surface of one engagement channel 220 to contact the engagement portion 208 of the respective guide spring 206, thereby causing the guide spring 206 to elastically deform in the X dimension, such as in outward direction 227, against the reactive force of that guide spring 206. Conversely, the rotation 225 of the connector 204 may cause the lower surface of an oppositely-disposed engagement channel 220 to contact the engagement portion 208 of an oppositely-disposed guide spring 206. This contact may result in the elastic deformation of that guide spring in the X dimension, such as in outward direction 224, against that guide spring's reactive force. Similar to the linear translations described above regarding FIG. 2D, once the force causing the rotation 225 of the connector 204 has ceased, the reactive forces of the guide springs 206, acting through the contact between the respective engagement portions 208 and engagement channels 220, may cause the connector 204 to return to its resting position, or, in other words, to re-center.

Figure 2F:
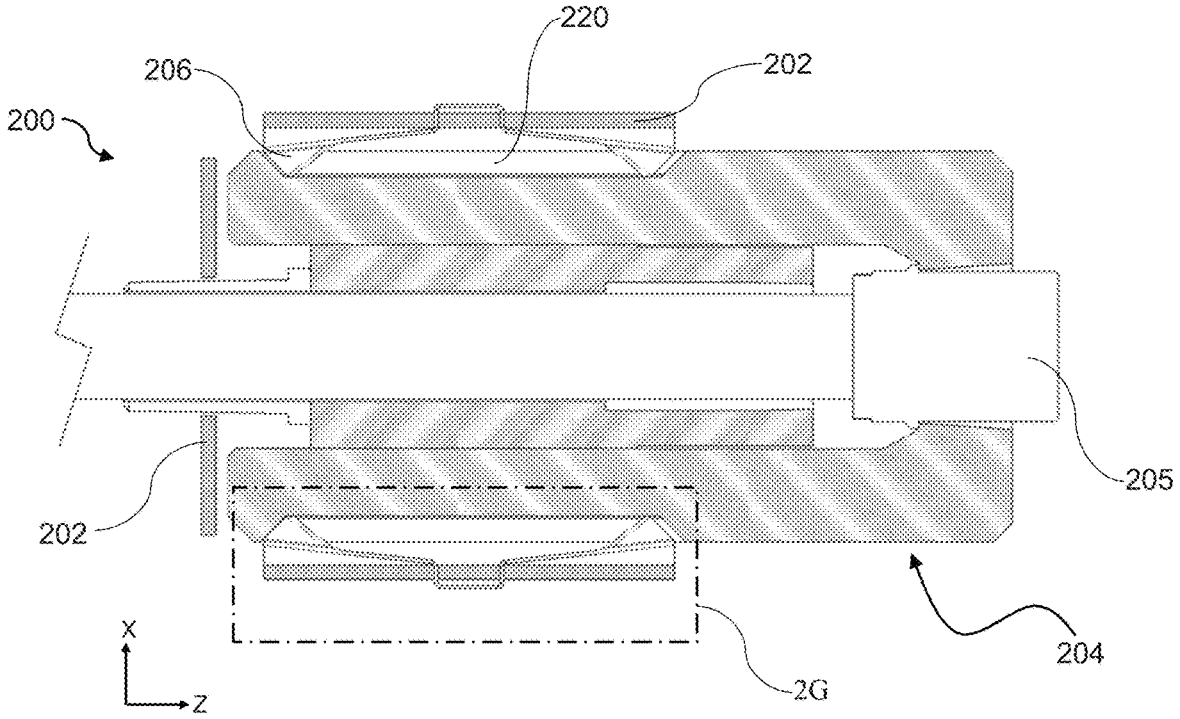
FIG. 2F is a top cross-sectional view of an example connector mount.
Figure 2G:
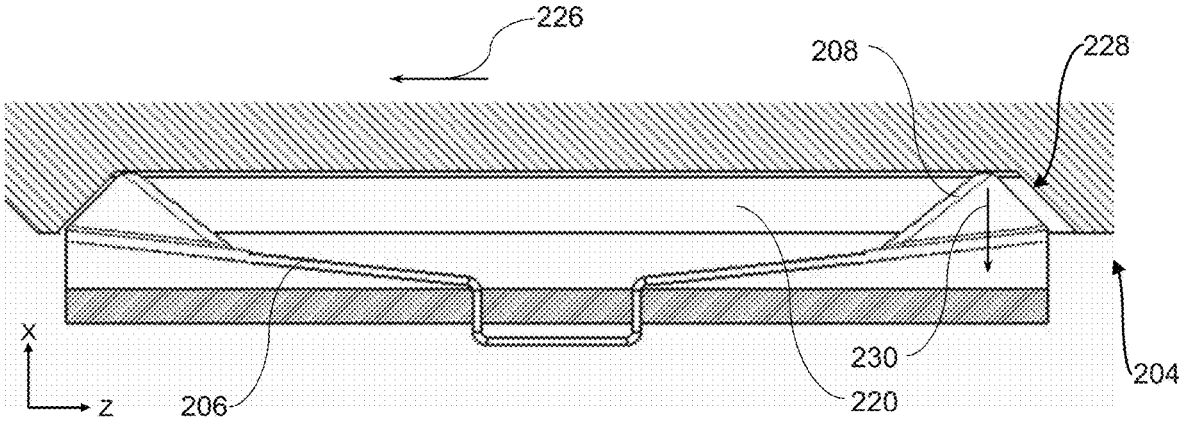
FIG. 2G is a detail view of an example guide spring of an example connector mount.

Referring now to FIGS. 2F-G, a top cross-sectional view of an example connector mount 200, as well as a detail view of a guide spring 206 therein, is illustrated. In some implementations, the example connector mount 200 may comprise at least one guide spring 206 having an engagement geometry 208 constructed to provide a reactive force of the guide spring 206 in the longitudinal Z dimension, in addition to the X dimension and the Y dimension, as described above. In some implementations, the guide springs 206 may extend longitudinally along the Z dimension. In further implementations, the guide springs 206 may be held in such a longitudinal position by the bracket 202 such that the guide springs 206 may engage with the engagement channels 220 of the connector 204 along the longitudinal direction.

In some implementations, an outside force may cause the translation of the connector 204 along the Z dimension, e.g., direction 226 of FIG. 2G. The connector 204 may translate along the Z dimension relative to the guide spring 206 until geometry of an engagement portion 208 of the guide spring 206 contacts an engagement surface of the engagement channel 220 that extends at least partially in the X dimension. In some implementations, such a surface may be angled in the X dimension, such as surface 228 of the engagement channel 220. In further implementations, such a surface may be curved or extend in the X dimension through a different geometry. As described above regarding FIG. 1C, such contact between the engagement portion 208 and the engagement surface of the channel 220 may transfer the Z dimension translation of the connector into translation of the engagement portion 208 in the X dimension, such as in direction 230. Such a translation of the engagement portion 208 may be against the reactive force of the guide spring 206. Thus, a translation of the connector 220 in the longitudinal, or Z dimension, may be against the bias or reactive force of the guide springs 206. Therefore, the reactive forces of the guide springs 206 may cause the guide springs 206 to provide resistance to the connector 204 if the connector moves in the longitudinal direction, and may return the connector 204 along the Z dimension to its starting position once the outside force causing the connector's movement ceases.

It must be noted that, similar to FIG. 2E, any rotation of the connector 204 in the X-Z plane may act as a series or combination of linear movements in each or both of the X dimension and the Z dimension. As such, a rotation of the connector in the X-Z plane may be against the bias or reactive forces of the guide springs, as described above. Further, a rotation of the connector 204 in the Y-Z plane (not shown) may also act as a series or combination of linear movements in each or both of the Y dimension and the Z dimension, and may, therefore, be against the bias or reactive forces of the guide springs 206. Accordingly, any translation of the connector 204 in any or some of the X, Y, or Z dimensions, as well as any rotation of the connector 204 in any or some combination of the X-Y, X-Z, or Y-Z planes may be against the bias or reactive forces of the guide springs 206 disposed in the connector mount 200. As such, the reactive forces of the guide springs 206 may return the connector 204 to its starting position once the force causing such a translation or rotation of the connector 204 ceases to be applied. Accordingly, the connector 204 may be able to float relative to the bracket 202 in any direction.

Note, the force or forces causing such a translation or rotation, or both, of the connector 204 may be due to interference with a misaligned mating connector. Thus, the connector 204 may be able to shift, translate, or rotate in any direction within the bracket 202 such that the connector 204 can engage with the mating connector for the transmission of data or signals. Once the engagement with mating connector is removed, the connector 204 may self-center, or return to its resting position within the bracket. Further, the force or forces may be caused by shock or vibration of the computer or server system, or the enclosure in which the server or computer component having the connector 204 is engaged with. The connector 204 may be properly engaged with a mating connector, and may be able to shift, translate or rotate in any direction within the bracket 202 due to external shock or vibration. This ability to move under shock or vibration may ensure the continued proper engagement of the connector 204 with the mating connector.

Figure 3A:
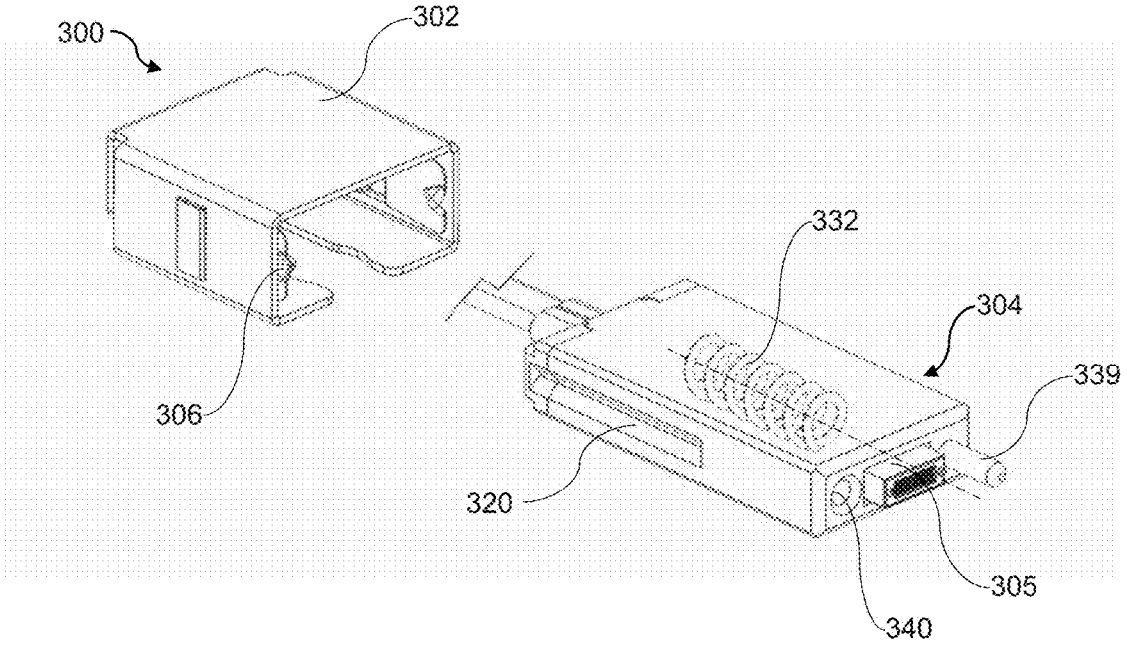
FIG. 3A is a perspective exploded view of an example connector mount.

Referring now to FIG. 3A, a perspective, exploded view of a connector mount 300 is illustrated. Connector mount 300 may be similar to connector mount 100 or 200. Further, the similarly named elements of connector mount 300 may be similar in function to the elements of connector mount 100 or 200, as they are described above. The connector mount 300 may comprise one or more guide springs 306 fixed to a bracket 302. The connector mount 300 may further comprise a connector 304, the connector 304 including a ferrule bias member 332. The ferrule bias member 332 may be disposed within the connector 304, and, as such, is shown in phantom in FIG. 3A. The connector 304 may further include alignment features 339 and 340.

Figure 3B:
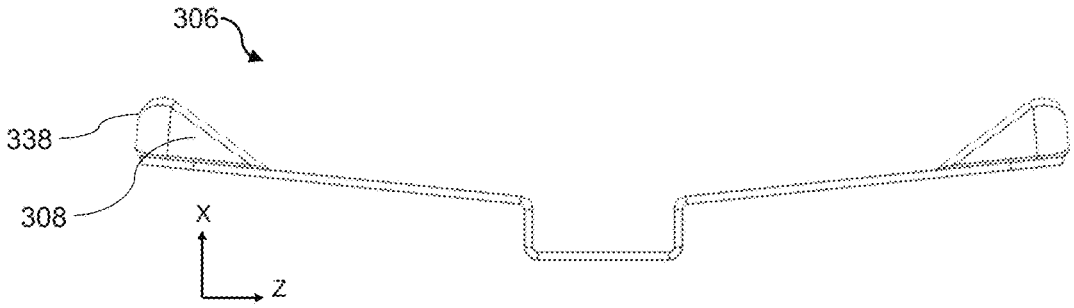
FIG. 3B is a top view of an example guide spring of an example connector mount.
Figure 3C:
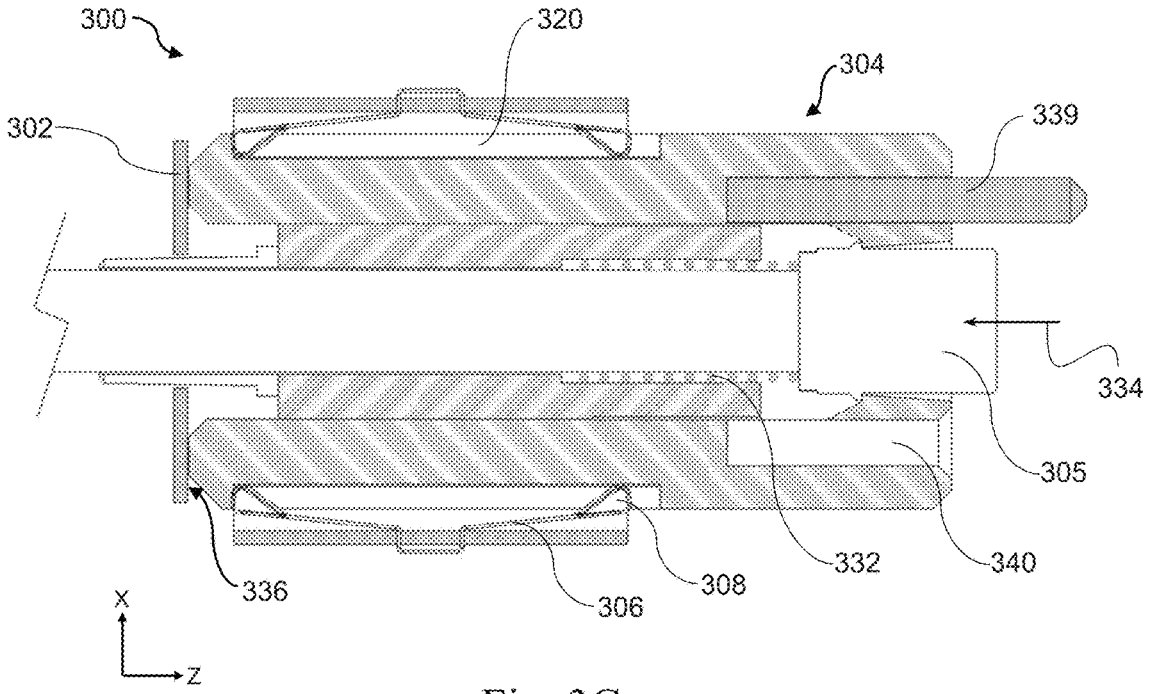
FIG. 3C is a top cross-sectional view of an example connector mount.

Referring additionally to FIG. 3B, a top view of an example guide spring 306 is illustrated. The guide springs 306 may include one or more engagement portions 308. The engagement portions 308 may, alone or collectively, include geometry such that the guide springs 306 may provide a reactive force in response to deformation from a force applied in the X or Y dimensions, but not in the Z dimension. The guide springs 306 may include geometry on the engagement portions 308 such as stopping surface 338 which may not allow force in the Z dimension to be transferred into deformation of the guide spring in the X dimension. Referring additionally to FIG. 3C, in some implementations, the stopping surfaces 338 of the guide springs 306 may removably fix the connector 304 within the mount 300, with the guide springs 306 holding the connector 304 directly against a stopping portion 336 of the bracket 302, such that the connector cannot float along the Z dimension.

The connector 304 may further include a ferrule bias member 332. The ferrule bias member 332 may be a resilient component that can return to its original shape after being deformed. In some implementations, the ferrule bias member 332 may provide a reactive force proportional to the degree of deformation of the ferrule bias member 332. The reactive force may be proportionate to the deformation of the ferrule bias member 332 in a linear, a progressive, or a degressive manner. In some implementations, the reactive force may be a constant reaction to the deformation of the ferrule bias member 332. The ferrule bias member 332 may comprise a coil or coils to achieve its elastic properties. In some implementations, the ferrule bias member 332 may comprise a metallic material, such as spring steel. In further implementations, the ferrule bias member 332 may comprise a polymer material, such as a plastic. In yet further implementations, the ferrule bias member 332 may comprise one or more compression springs.

In some implementations, the ferrule bias member 332 may be disposed within the connector 304 and fixed to or engaged with a connection ferrule 305. The ferrule bias member 332 may be engaged with the connection ferrule 305 such that the ferrule bias member 332 allows the connection ferrule 305 to resistively move in the longitudinal or Z dimension, relative to the connector and the bracket 302. In some implementations, the ferrule bias member 332 may be a compression spring and be disposed in between the connection ferrule 305 and the stopping portion 336 of the bracket 302, such that the ferrule may be moved in a direction 334 against the reactive force of the ferrule bias member 332. Therefore, when the motive force causing the movement of the connection ferrule 305 ceases, the reactive force of the ferrule bias member 332 returns the ferrule to its resting position. In other words, the ferrule bias member 332 may enable the connection ferrule 305 to float in the Z dimension.

In some implementations, the connector 304 may further include alignment features 339 and 340. The alignment features 339 and 340 may assist in aligning the connector 304 for engagement with a mating connector. The alignment features may comprise, in some implementations, a male portion 339 and a female portion 340. Further, the mating connector may include complementary female and male alignment features to engage with the male portion 339 and the female portion 340, respectively. In further implementations, the alignment features 339 and 340 may sometimes be misaligned from the complementary alignment features on the mating connector. Such misalignment may be slight enough such that each alignment feature can partially engage with its complementary feature on the mating connector. In such a situation, the partial engagement of each feature with its corollary feature on the mating connector may cause the connector 304 to move or float within the bracket 302, against the reactive forces of the guide springs 306, the ferrule bias member 332, or both. Such movement or flotation within the bracket 302 may allow the connector 304 to shift its position enough such that the alignment features 339 and 340 can fully engage the complementary features on the mating connector and the connection ferrule 305 can fully engage with a mating ferrule on the mating connector. In further implementations, the connection ferrule 305 may also include alignment features. The ferrule alignment features may have a similar function and/or structure to the alignment features 339 and 340. The ferrule alignment features may further comprise a structure that is smaller in scale than the alignment features 339 and 340.

Figure 4:
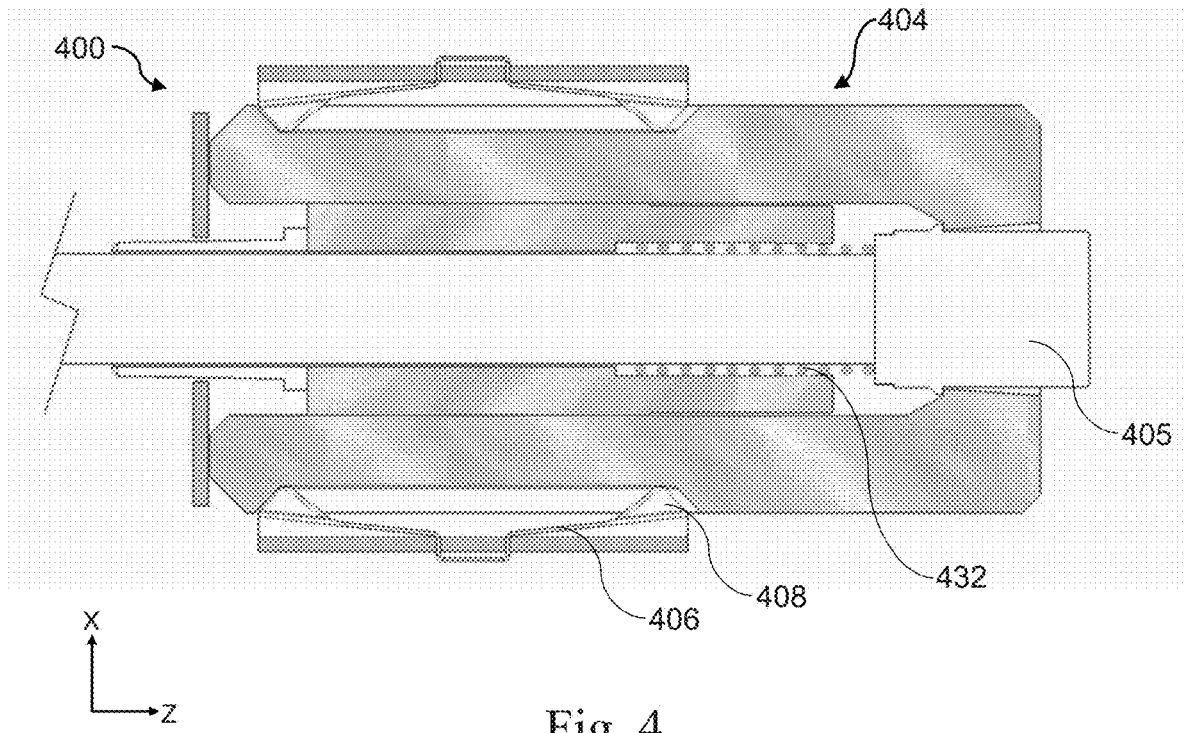
FIG. 4 is a top cross-sectional view of an example connector mount.

Referring now to FIG. 4, a top cross-sectional view of an example connector mount 400 is illustrated. Connector mount 400 may be similar to connector mount 100, 200, or 300. Further, the similarly named elements of connector mount 400 may be similar in function to the elements of connector mount 100, 200, or 300, as they are described above. The connector mount 400 may comprise guide springs 406, and a connector 404. The connector 404 may include a ferrule bias member 432 engaged with a connection ferrule 405.

The guide springs 406 may be resilient components and may include one or more engagement portions 408. The engagement portions 408 may, alone or collectively, include geometry such that each guide spring 406 may provide a reactive force in response to deformation from a force applied in any of the X, Y, or Z dimensions, as described above. Further, the ferrule bias member 432 may further provide float capability to the connection ferrule 405 along the Z dimension, as described above regarding bias member 332. Therefore, both the guide springs 406 and the ferrule bias member 432 may be able to, separately or together, provide float capability to the connection ferrule 405.

Figure 5:
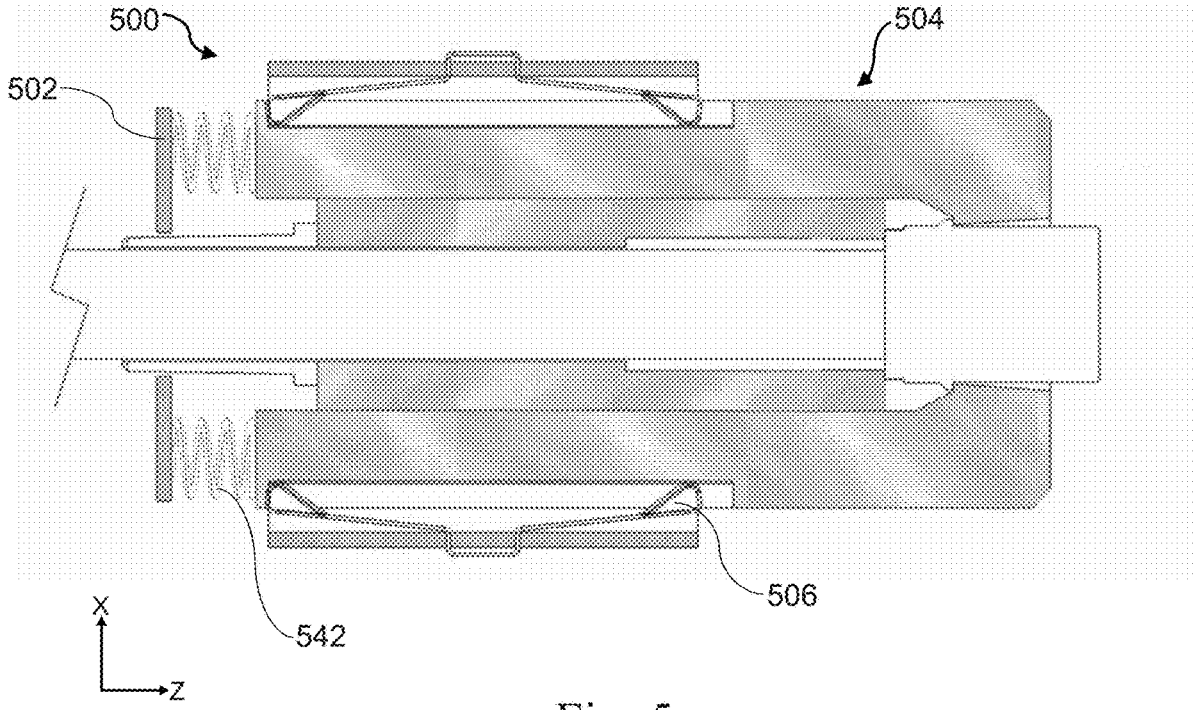
FIG. 5 is a top cross-sectional view of an example connector mount.

Referring now to FIG. 5, a top cross-sectional view of an example connector mount 500 is illustrated. Connector mount 500 may be similar to any of the previously described connector mount examples, above. Further, the similarly named elements of connector mount 500 may be similar in function to the other connector mount examples, as they are described above. Connector mount 500 may include guide springs 506 and connector springs 542.

Guide springs 506 may include geometry such that the guide springs 506 may provide a reactive force in response to deformation from a force applied in the X or Y dimensions, but not in the Z dimension. Such deformation may come from the movement of the connector 504 in the X or Y dimesnions. The guide springs 506 may include geometry which may not allow force applied to the connector 504 in the Z dimension to be transferred into deformation of the guide springs in the X dimension. Further connector springs 542 may be engaged with the connector 504 and a bracket 502 of the connector mount 500. The connector springs 542 may be resilient components, as described above regarding ferrule bias member 332, and may provide a reactive force to the connector 504 when the connector 504 is moved in the Z dimension. In some implementations, the connector springs 542 may be compression springs, and, in further implementations, the connector springs 542 may be coil compression springs. Therefore, the guide springs 506 may provide float capability to the connector 504 in the X and Y dimensions, while the connector springs 542 may provide float capability to the connector in the Z dimension.

Figure 6A:
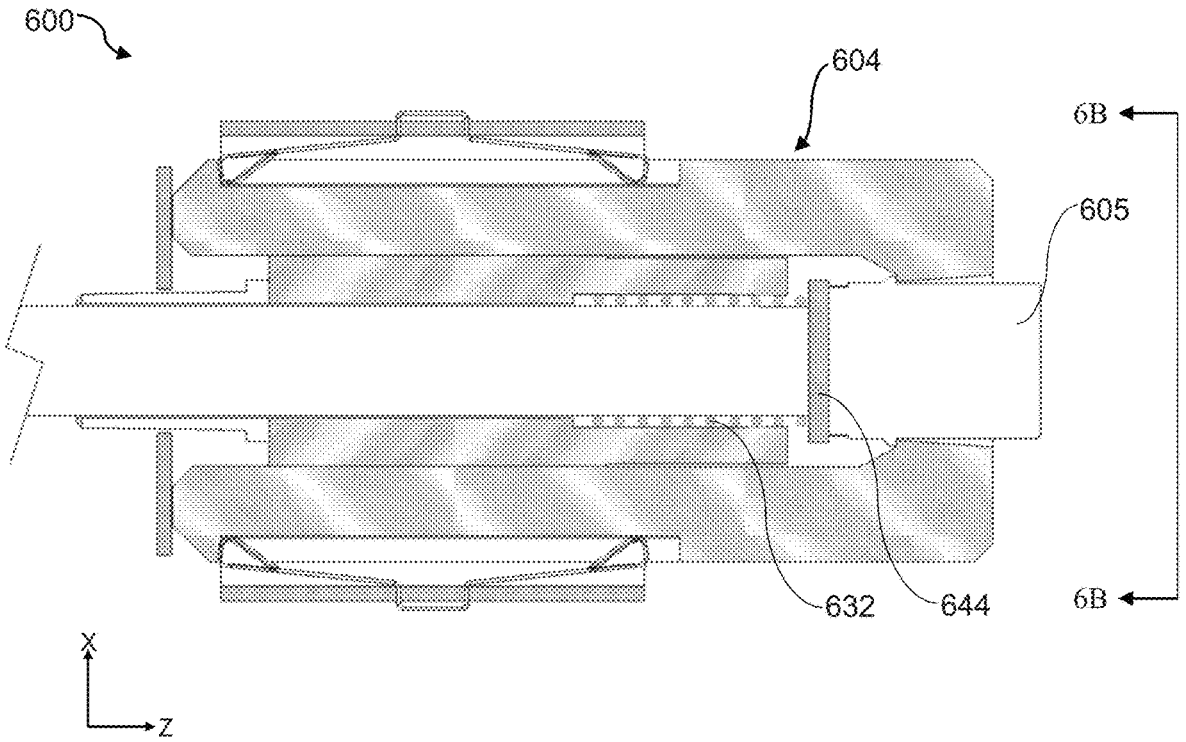
FIG. 6A is a top cross-sectional view of an example connector mount.
Figure 6B:
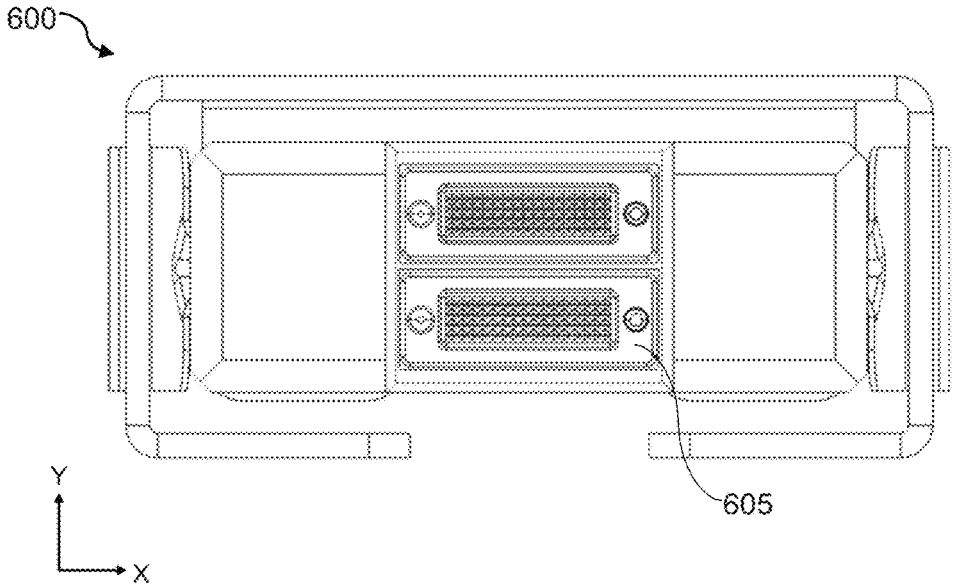
FIG. 6B is a front view of an example connector mount.

Referring now to FIGS. 6A-B, a top cross-sectional view of an example connector mount 600, as well as a front view of example connector mount 600 are illustrated. Connector mount 600 may be similar to any of the previously described connector mount examples, above. Further, the similarly named elements of connector mount 600 may be similar in function to the other connector mount examples, as they are described above.

Connector mount 600 may comprise multiple connection ferrules 605, a spring plate 644, and a ferrule bias member 632. The spring plate 644 may be a member engaging the plurality of connection ferrules 605 with the ferrule bias member 632. In some implementations, the spring plate 644 may engage the plurality of connection ferrules 605 with multiple bias members that comprise the ferrule bias member 632. The plurality of connection ferrules 605 may be engaged with the ferrule bias member 632 such that any translation of one or more of the plurality of connection ferrules 605 in the Z dimension is against the reactive force of the ferrule bias member 632. The spring plate 644 may transfer the translation of the plurality of connection ferrules 605 in the Z dimension into an elastic deformation of the bias member 632 in the Z dimension. Therefore, the ferrule bias member 632 may allow the plurality of connection ferrules 605 to float in the Z dimension. In some implementations, the plurality of connection ferrules 605 may be arranged in a vertical direction, along the Y dimension, as seen in FIG. 6B. In further implementations, the plurality of connection ferrules 605 may be arranged in another orientation.

What is claimed is:

1. A connector mounting system, comprising:

a connector including:

a first engagement channel, a second engagement channel, a connection ferrule, and a bias member fixed to the connection ferrule and allowing the connection ferrule to resistably move in a longitudinal direction;

a bracket;

a first guide spring fixed to the bracket to be received by the first engagement channel, wherein the first engagement channel includes a complementary geometry to the first guide spring; and a second guide spring fixed to the bracket to be received by the second engagement channel, wherein the second engagement channel includes a complementary geometry to the second guide spring, wherein the first and second guide springs each engage with the connector and allow the connector to resistably move in a vertical direction and a horizontal direction, including translational and rotational movement.

2. The connector system of claim 1, wherein the first and second guide springs are disposed on opposing sides of the bracket.

3. The connector system of claim 2, wherein the first and second engagement channels comprise a V-shaped cross-section.

4. The connector system of claim 3, wherein the connector further includes alignment features to engage with complementary alignment features on a mating connector.

5. The connector system of claim 1, wherein the connector is an optical connector.

6. A connector mounting system, comprising:

a connector with a first engagement channel and a second engagement channel, wherein the connector includes a connection ferrule engaged with a bias member, such that the bias member allows the ferrule to resistably move in a longitudinal direction;

a bracket;

a first guide spring to be received by the first engagement channel; and a second guide spring to be received by the second engagement channel, the first guide spring and the second guide spring being fixed to opposing sides of the bracket;

wherein:

the first engagement channel includes a complementary geometry to the first guide spring; and the second engagement channel includes a complementary geometry to the second guide spring;

wherein the first and second guide springs engage with the connector such that the guide springs allow the connector to resistably move in a vertical, a horizontal, and a longitudinal direction, including translational and rotational movement.

7. The connector mounting system of claim 6, wherein the connector further includes a plurality of connection ferrules engaged with the bias member.

8. The connector mounting system of claim 7, wherein the connector includes multiple bias members engaged with the plurality of ferrules and a spring plate disposed between the connection ferrules and the bias members.

* * * * *